United States Patent [19]

Schmitz

[11] Patent Number: 5,072,589

[45] Date of Patent: Dec. 17, 1991

[54] INTERNAL COMBUSTION ENGINE HAVING MULTIPLE EXPANSION AND COMPRESSION

[76] Inventor: Gerhard Schmitz, Silvio-Gsell-Strasse 19, B-4780 Saint-Vith, Belgium

[21] Appl. No.: 447,268

[22] Filed: Dec. 7, 1989

[30] Foreign Application Priority Data

Dec. 30, 1988 [BE] Belgium ..... 8801451

[51] Int. Cl.[5] ..... F02B 33/06

[52] U.S. Cl. ..... 60/622; 123/70 R; 123/560; 60/620

[58] Field of Search ..... 123/70 R, 560; 60/620, 60/622

[56] References Cited

U.S. PATENT DOCUMENTS 1,325,810 12/1919 Sperry ..... 60/622
1,347,087 7/1920 Gernandt ..... 60/622

FOREIGN PATENT DOCUMENTS 0362855 11/1922 Fed. Rep. of Germany ..... 60/622
0664611 8/1938 Fed. Rep. of Germany ..... 60/622
0697682 11/1940 Fed. Rep. of Germany ..... 60/622
0614873 12/1926 France ..... 60/622
0771168 10/1934 France ..... 60/622

*Primary Examiner*—Willis R. Wolfe
*Assistant Examiner*—Thomas N. Moulis
*Attorney, Agent, or Firm*—Steinberg & Raskin

[57] ABSTRACT

A staged two-stroke internal combustion engine with reciprocating pistons wherein the cycle comprises a first compression of fresh air possibly followed by a cooling, a second compression of air or of mixture or the injection of fuel (Diesel version), a first expansion producing a useful work, a second expansion also producing a useful work and the exhaust of the combustible gases followed by the scavenging of the remaining gases by fresh air, the engine preferably including an odd number greater than or equal to three cylinders and allowing to increase the power output efficiency and the power-to-swept volume ratio with respect to the four-stroke internal combustion engine.

7 Claims, 4 Drawing Sheets

INTERNAL COMBUSTION ENGINE HAVING MULTIPLE EXPANSION AND COMPRESSION

BACKGROUND OF THE INVENTION

The present invention relates to a method of providing an internal combustion engine of the kind comprising at least one power cylinder which includes a working chamber with a volume variable by the displacement within the cylinder of a piston between a top dead center position and a bottom dead center position under the effect of pressure forces periodically generated within said chamber whereas with each cylinder are associated intake and exhaust means for a gaseous fluid, the piston of each cylinder being connected to a crankshaft of the engine, as well as an engine for carrying out this method.

The known engines of this type make use of either a two-stroke or a four-stroke thermodynamic cycle. In a four-cycle engine the cylinder is filled with an air-fuel mixture when the piston is near its bottom dead center. Then while moving forward the piston would compress this mixture and the fuel would vaporize under the rise of the temperature. When the piston arrives near its top dead center an ignition plug would ignite the mixture by means of a spark thereby inducing a sudden elevation in temperature and in pressure. When moving backwards the piston allows the combustion gases to expand and it is at this time that a usable work is produced. When it arrives near its bottom dead center the gases are discharged through an exhaust valve arranged in the cylinder head in view of a so-called longitudinal scavenging or through exhaust ports formed in the cylinder liner, sleeve or barrel and uncovered by the piston owing to a so-called cross-flow scavenging. The residual gases are then scavenged or swept out by the incoming flow of the fresh air-fuel mixture which is fed through scavenging ports formed at the lower portion of the cylinder liner, sleeve or barrel and uncovered by the piston a little later than the exhaust ports. Both cycles therefore are the compression and the expansion.

The four cycle Diesel engine makes use of a comparable principle where the difference consists in the manner of introducing the fuel which in this case is directly injected into the compressed hence hot air and would then ignite spontaneously.

In both cases the energy output efficiency would depend among other factors from the volumetric compression ratio. The higher the compression ratio, the higher the efficiency. Now this compression ratio is limited in the case of an engine operating with gasoline by the risk of premature hammering or preknocking of the mixture and in the case of a Diesel engine among other factors by the necessity of preserving a suitable combustion chamber. In any case with a thermodynamic cycle such as described hereinabove, the increase in output efficiency becomes weaker and weaker for an equal increase in the compression ratio from a value of 10 to 15 of the latter and in the case of a Diesel engine there mainly are the mechanical stresses which would determine the critical volumetric compression ratio.

The output efficiency of the two-stroke cycle with controlled ignition generally is lower than that of the four-stroke cycle since a fuel loss is unavoidable during the scavenging of the combustion gases by the fresh air-fuel mixture. Another defect of the two-stroke cycle with controlled ignition as compared with that of a four-stroke cycle is the bad operation under partial load wherein a throttling at the suction would result in a greater dilution of the fresh charge by the combustion gases during the scavenging which may therefore make the combustion difficult.

The main object of the present invention is to increase the power efficiency of the two-cycle internal combustion engine with reciprocating pistons of the kind defined hereinabove.

To reach this goal the method according to the invention is characterized in that it consists in using at least one cylinder operating as a low pressure two-stroke cylinder and two cylinders operating as combustive cylinders, in that at each stroke of the piston of the low pressure cylinder towards its top dead center the gaseous fluid let thereinto is alternately discharged into one of the two combustive cylinders, in that the latter is caused to then successively perform an intake stroke for admitting the fluid to which fuel has been added, a stroke for compressing the air-fuel mixture, a stroke of a first expansion of the combustible gases after the ignition of the fluid and a stroke of discharging the combustible gases into the low pressure cylinder during the second expansion stroke thereof following that of said discharge of fresh air with a view to perform a second expansion of the combustible gases and their exhaust from the engine.

The engine for putting this process into practice is characterized in that the pistons of the low pressure and combustive cylinders, respectively, are connected to the crankshaft so that the pistons of the combustive cylinders on the one hand and the piston of the low pressure cylinder on the other hand would move in opposite directions, the low pressure working chamber is likely to communicate with a gaseous fluid intake way and with a combustible gases exhaust way and with the working chamber of each combustive cylinder on the one hand through a way for discharging fresh air into this working chamber through the agency of a discharge valve associated with the low pressure cylinder and of an inlet valve associated with the combustive cylinder and on the other hand through a way for transferring the combustible gases through the medium of a transfer valve associated with the combustive cylinder and in that the valves are operated so that said discharge valve be open during the stroke of the piston of the low pressure cylinder towards its top dead center at the same time as and in alternating relationship with the inlet valve of one of the two combustive cylinders and in that the transfer valve of a combustive cylinder is open during the second stroke of the piston of the low pressure cylinder towards its bottom dead center after the intake of the gaseous fluid into this cylinder.

The invention will be better understood and further objects, characterizing features, details and advantages thereof will appear more clearly as the following explanatory description proceeds with reference to the accompanying diagrammatic drawings given by way of non-limiting examples only illustrating two presently preferred specific embodiments of the invention and wherein.

Figure 1:
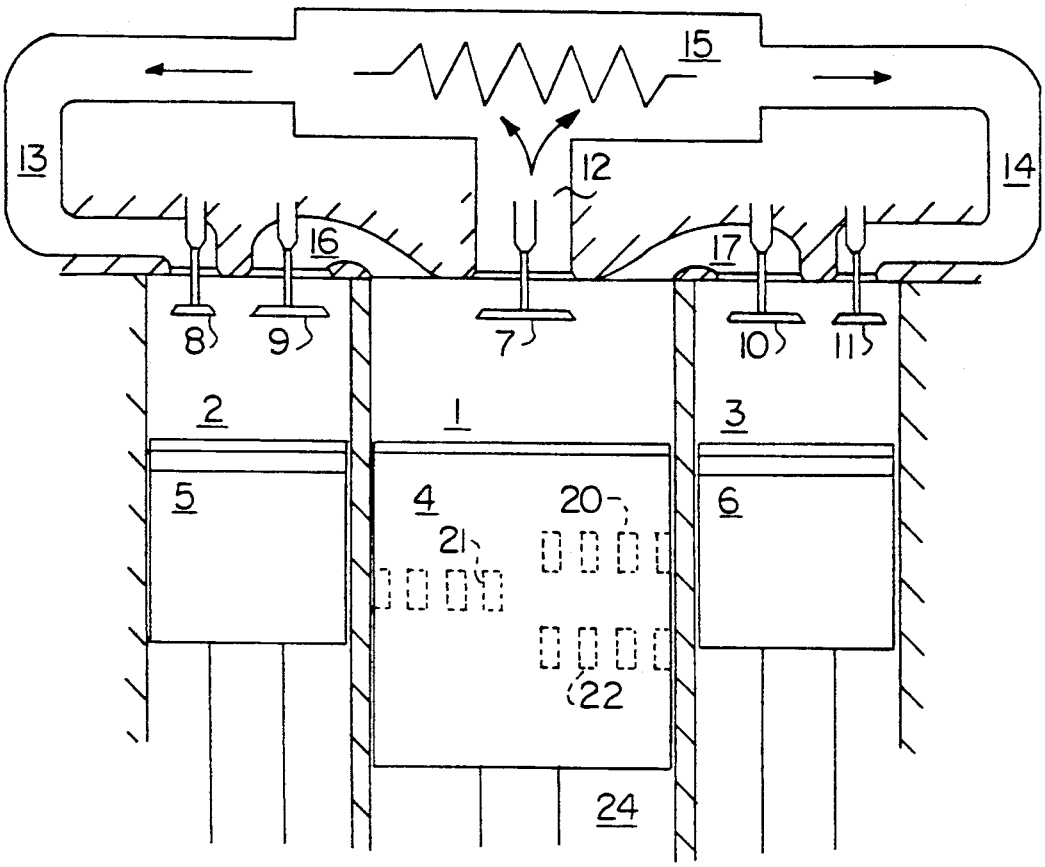
FIG. 1 is a view in vertical section of the engine block of a first embodiment with three cylinders of an engine according to the invention.
Figure 2:
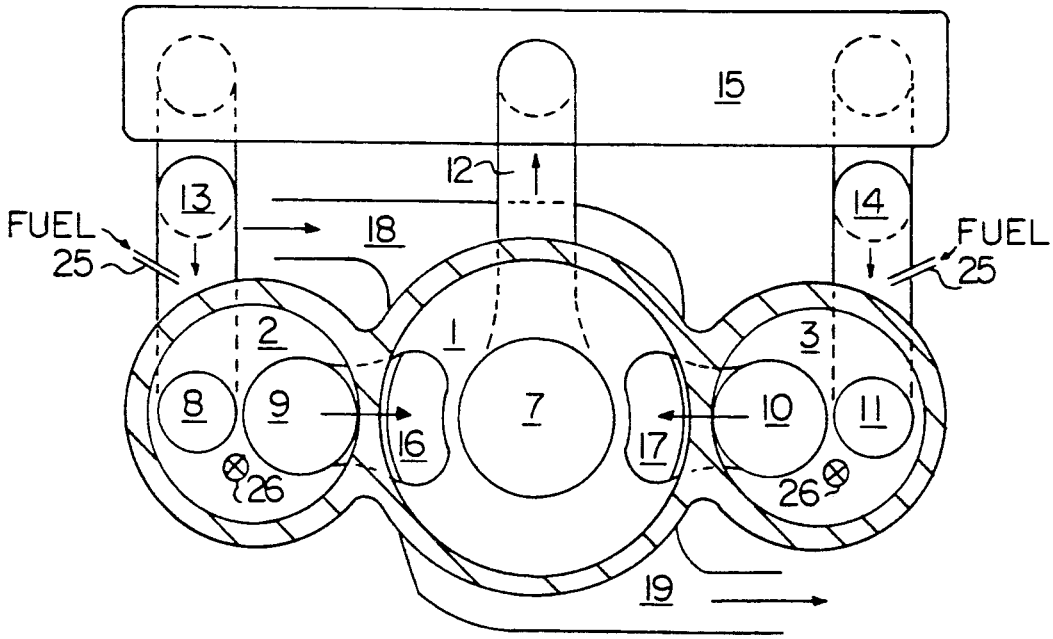
FIG. 2 is a view in horizontal section of the engine block shown on FIG. 1.
Figure 4A:
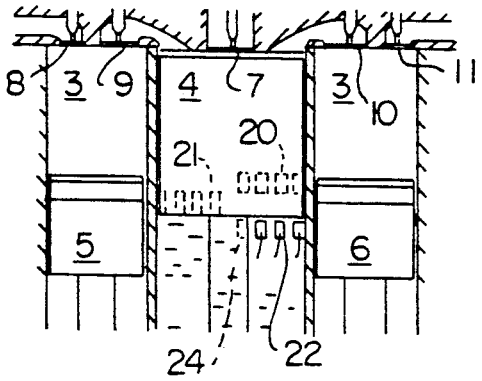
Figure 4B:
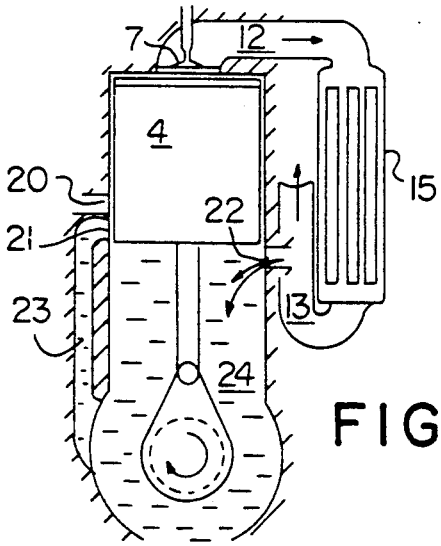
Figure 5A:
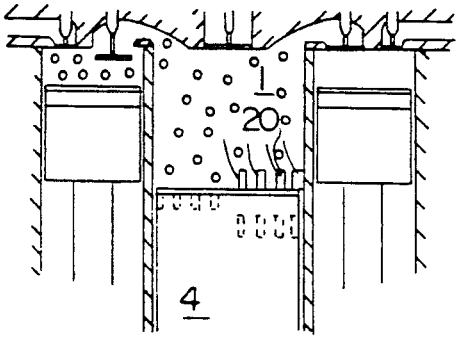
Figure 5B:
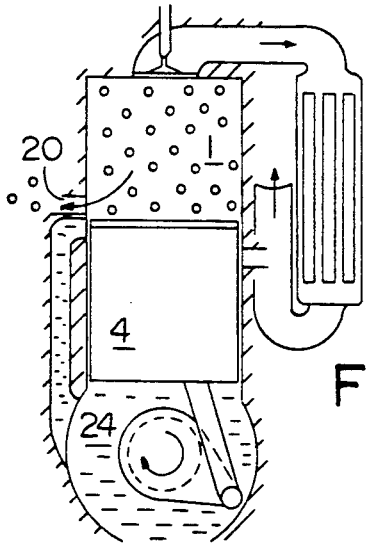
Figure 6A:
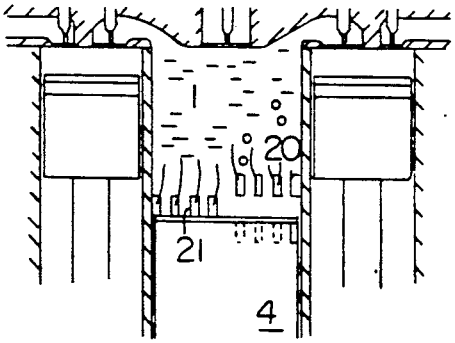
Figure 6B:
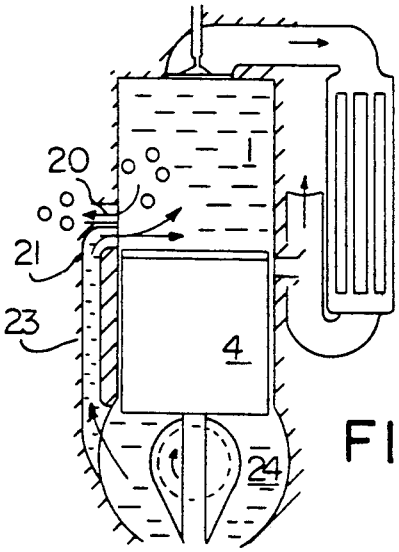
Figure 7A:
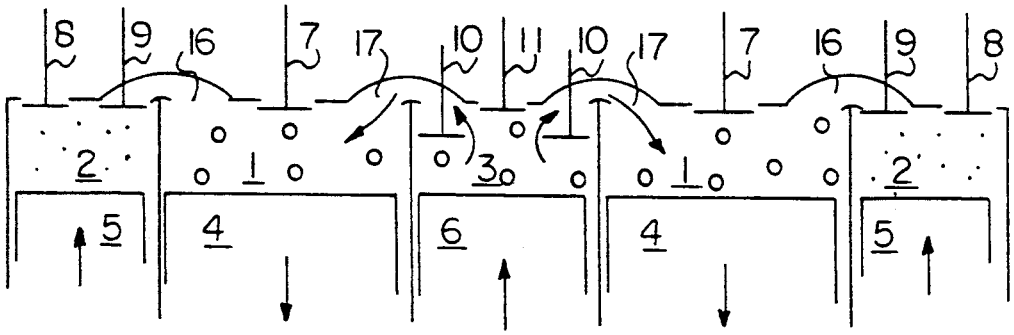
Figure 7B:
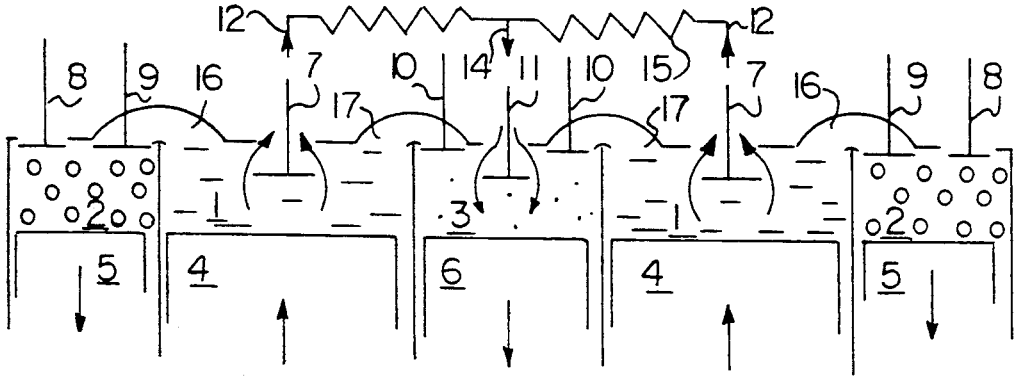
Figure 7C:
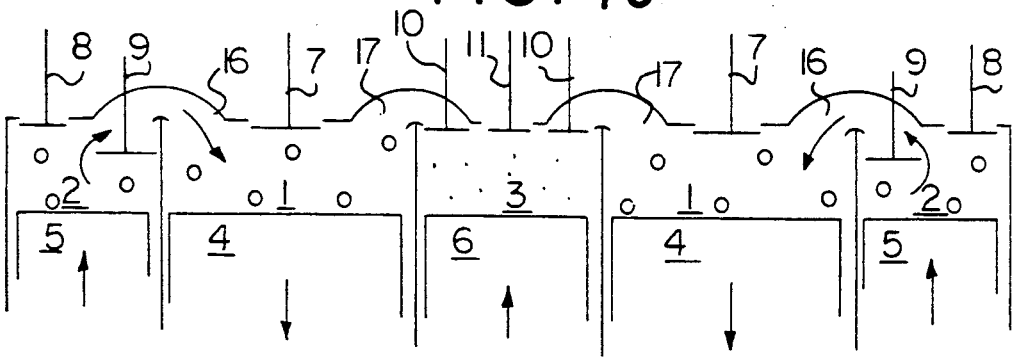
Figure 7D:
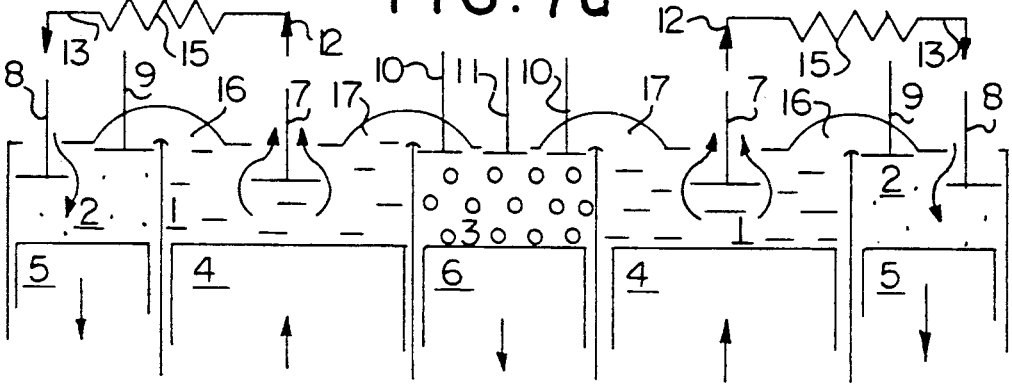

FIGS. 3*a* to 3*d* illustrate four operating steps or phases of the engine according to the invention shown on FIG. 1;

FIGS. 4*a* and 4*b* show the suction of air drawn into the casing of the two-cycle low pressure cylinder;

FIGS. 5*a* and 5*b* illustrate the exhaust of the combustible gases from the two-stroke low pressure cylinder in the case of the cross-flow scavenging version;

FIGS. 6*a* and 6*b* illustrate the cross-flow scavenging of the residual combustible gases by the air in the two-stroke low pressure cylinder; and FIGS. 7*a* to 7*d* diagrammatically illustrate the four phases or steps taking place during two revolutions of the crankshaft in a four-cycle internal combustion engine and with five cylinders constituting a second embodiment of the invention.

DESCRIPTION OF THE PREFERRED EMBODIMENTS

FIGS. 1 to 6 relate to a first embodiment of an engine according to the invention, namely an engine with staged two-cycle internal combustion through controlled ignition which is carried out by means of three cylinders aligned in a row. It comprises two high pressure combustive cylinders 2, 3 located at the ends of the crankshaft and a four cycle low pressure central cylinder 1. The volume of the low pressure cylinder 1 is greater than those of the combustive cylinders 2, 3. A heat exchanger 15 is connected to the low pressure cylinder 1 through a piping 12 for discharging pre-compressed air and its outlet is connected to both high pressure combustive cylinders 2, 3 through pipings 13, 14, respectively, for taking the pre-compressed air-fuel mixture in. The piping 12 may be closed by a discharge valve 7 associated with the low pressure cylinder whereas the pipings 13, 14 are provided with inlet valves 8, 11 associated with the combustive cylinders 2, 3. It is at these inlet pipings 13 and 14 that the fuel is fed in by means of an actuated injection device 25 or of a carburettor. The working chambers of the combustive cylinders 2, 3 are connected to the working chamber of the low pressure cylinder 1 by the pipings 16, 17 for transferring the combustible gases, respectively. The transfer pipings 16, 17 are provided with transfer valves 9, 10, respectively, associated with the combustive cylinders. The transfer valves 9 and 10, the inlet valves 8 and 11 for the air or for the air-fuel mixture as well as the ignition plugs 26 are located in the cylinder head of the high pressure combustive cylinders 2 and 3. The low pressure cylinder sleeve 1 is formed with exhaust ports 20 for the combustible gases and with intake ports 22 for the fresh air, which are connected to a combustible gases exhaust manifold 19 and to a fresh air intake manifold 18, respectively. The low pressure casing 24 located downstream of the piston 4 of the cylinder 1 is an enclosed space which is connected by means of ports 21 and of a scavenging piping 23 to the portion upstream of the low pressure piston 4.

In this configuration the three cylinders 1 to 3, the two-stroke low pressure cylinder 1 forms with the left high pressure combustive cylinder 2 at first a first pair of compressing cylinders and a first pair of expanding cylinders. Together with the right high pressure combustive cylinder 3 the low pressure cylinder 1 forms at first a second pair of compressing cylinders and also a second pair of expanding cylinders. This will appear from the following description of the operation of the engine with reference to FIGS. 3*a* to 3*d*. These Figures show in detail the four phases which occur during two revolutions of the crankshaft in the engine shown on FIGS. 1 and 2. On FIGS. 3*a* to 3*d* those zones which are provided with simple dots are zones filled with air-fuel mixture and those zones which are provided with small circles or ringlets represent zones which are filled with combustible gases.

(FIG. 3*a*) The pistons 5 and 6 of the high pressure combustive cylinders 2 and 3 are about to rise or moving upwards and the piston 4 of the two-cycle low pressure cylinder 1 is in the process of moving downwards. The first pair of expanding cylinders, i.e. the left high pressure combustive cylinder 2 and the central two-stroke low pressure cylinder 1 would effect a second expansion of the combustible gases, the transfer valve 9 being open. When the two-stroke low pressure piston 4 is approaching its bottom dead center the combustible gases will be discharged through the exhaust ports 20 and the remainder of these gases will be scavenged by the fresh air supplied by means of the intake ports 21. The right high pressure combustive cylinder 3 would effect a second compression of the air-fuel mixture and the plug 26 will ignite the same towards the end of this compression.

(FIG. 3*b*) Both high pressure combustive pistons 5 and 6 are in the process of moving downwards while the two-stroke low pressure piston 4 is rising. The first pair of compressing cylinders, i.e. the right high pressure combustive cylinder 2 and the two-stroke low pressure cylinder 1 would effect the first compression, the pre-compressed air discharge valve 7 and the air-fuel mixture intake valve 8 being open. Gasoline is fed in at the intake piping for the pre-compressed air-fuel mixture 13. The right-hand side high pressure combustive cylinder 3 would effect the first expansion of the combustible gases.

(FIG. 3*c*) Both high pressure combustive pistons 5 and 6 are moving upwards again a second time while the two-stroke low pressure piston 4 is moving downwards again. The second pair of expanding cylinders, i.e. the two-stroke low pressure cylinder 1 and the right-hand high pressure combustive cylinder 3 would effect in turn the second expansion of the combustible gases, the corresponding transfer valve 10 being open. When the two-stroke low pressure piston 4 is approaching its bottom dead center the combustible gases will be discharged through the exhaust ports 20 and the remainder of these gases will be scavenged by the fresh air supplied by means of the intake ports 21. The left-hand high pressure combustive cylinder 2 is performing in turn the second compression of the air-fuel mixture which will be ignited by means of a plug 26 towards the end of this compression.

(FIG. 3*d*) The high pressure combustive pistons 5 and 6 are moving downwards again while the two-stroke low pressure piston is moving upwards again. The second pair of compressing cylinders, i.e. the two-stroke low pressure cylinder 1 and the right-hand high pressure combustive cylinder 3 now effects the first compression, the pre-compressed air discharge valve 7 and the corresponding pre-compressed air-fuel mixture intake valve 11 being open. Gasoline is fed in at the intake piping 14 for the pre-compressed air-fuel mixture. The left-hand high pressure combustive cylinder 2 performs the first expansion of the combustible gases.

Figure 3A:
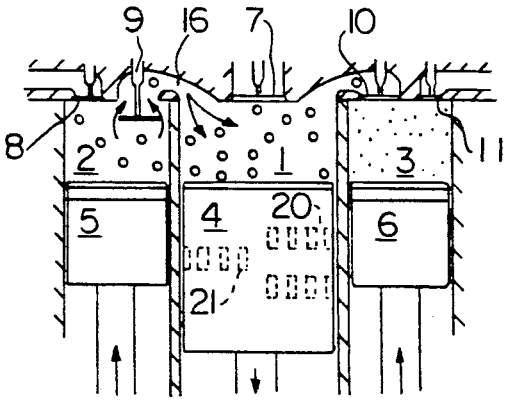
Figure 3B:
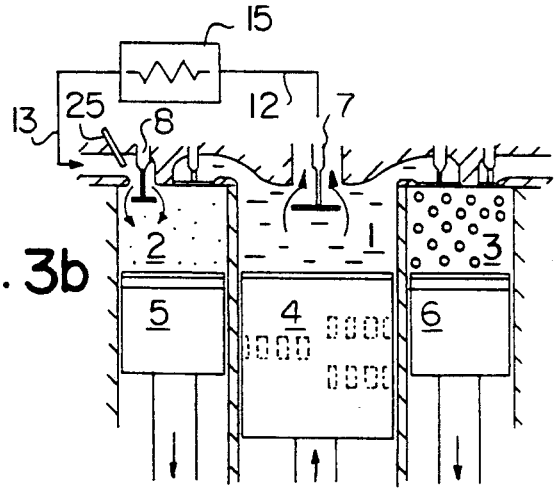
Figure 3C:
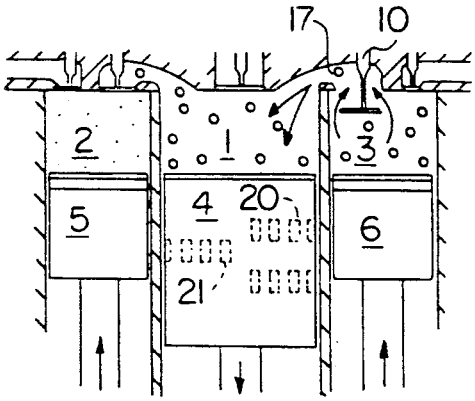
Figure 3D:
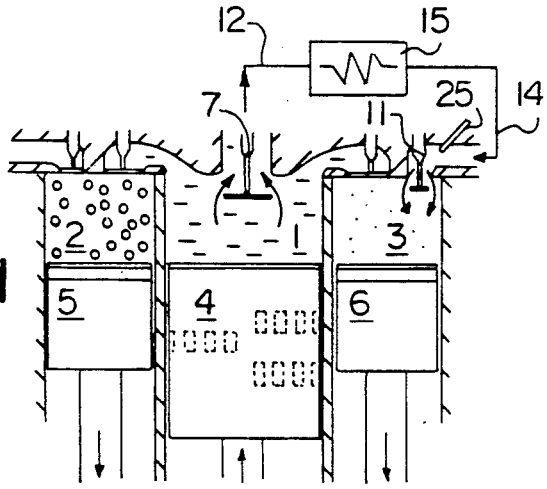

The next phase is the one illustrated in FIG. 3*a*.

Another embodiment of the staged two-cycle internal combustion engine with three cylinders would be an engine such as just described but wherein the difference consists in the manner of introducing the fuel which this time will be directly injected towards the end of the second compression at the combustion chambers of the high pressure combustive cylinders 2 and 3 where it would then ignite spontaneously. The power or capacity of the radiator 15 as well as the piston displacements or swept stroke volume and compression ratios should of course be readjusted.

From this embodiment of the engine with three cylinders may be derived with reference to FIG. 7 that with five cylinders by juxtaposing two engines with three cylinders by arranging them in a line or row so that both high pressure combustive central cylinders would perfectly operate in phase. They may then be "fused" into one single high pressure central combustive cylinder 3 which would then have a swept stroke volume or displacement preferably twice as great as those of both high pressure combustive cylinders located at the ends of the crankshaft 2. The central high pressure combustive cylinder 3 would communicate with both neighboring two-stroke low pressure cylinders 1 by means of transfer valves 10 and pipings 17. The second expansion of the combustible gases located in this cylinder 3 will take place by transferring them simultaneously towards both adjacent two-stroke low pressure cylinders 1. FIGS. *7a* to *d* show again in detail the four phases which are met during two revolutions of the crankshaft in the staged two-cycle internal combustion engine with five cylinders wherein the zones hatched with horizontal lines are filled with air only and those hatched with small circles or ringlets are filled with combustible gases.

This fashion of proceeding is of course not limited to five cylinders and it is thus possible to provide staged two-cycle internal combustion engines with 5, 7, 9, . . . cylinders. All these embodiments are adapted to both types of spontaneous and controlled ignition.

All these versions of the staged two-cycle internal combustion engine are of course also suited to a longitudinal scavenging where the exhaust ports will then be replaced by at least one exhaust valve formed in the cylinder head of the two-stroke low pressure cylinder.

The staged two-stroke internal combustion engine forming the subject matter of the present invention will be usable everywhere where are presently used conventional internal combustion engines, in particular in the road transport.

It is seen that the four-stroke internal combustion engines with reciprocating pistons which have just been described by way of illustrative example make it possible to increase the power output efficiency of the two-cycle internal combustion engine with reciprocating pistons with respect to the known engines. To reach this aim there is provided a staged two-stroke thermodynamic cycle. This cycle comprises a first compression, a second compression, a first expansion of the combustible gases generating a usable mechanical work and eventually a second expansion of the gases also generating a usable mechanical work. The suction of air and the exhaust of the combustible gases are carried out towards the end of the second expansion and at the start of the first expansion according to the conventional principle of the four-cycle internal combustion engine wherein takes place a scavenging of the combustible gases by the air or by the fresh air-fuel mixture when the piston is near its bottom dead center. This new cycle at first allows to increase the overall compression ratio and then the scavenging of the combustible gases by the air alone. This is also possible in the gasoline version where gasoline would be fed in between the compression stages.

In the case of the gasoline version the increase of the overall compression ratio requires an extensive cooling between both compression stages in order to avoid the risk of a premature hammering or preknocking of the air-fuel mixture.

The high pressure combustive cylinders only serve the purpose of receiving the air or the pre-compressed air-fuel mixture, of compressing the same the second time, of undergoing the combustion, of expanding the combustible gases the first time and eventually of discharging these same gases under high pressure through the transfer piping(s).

The two-stage low pressure cylinder has the sole function of compressing and discharging the fresh air, of receiving the combustible gases under high pressure and of participating in their second expansion, the exhaust of the combustible gases followed by the scavenging of the remaining gases by the fresh air being performed towards the end of the second expansion when the piston is near its bottom dead center.

The intake of fresh air into the two-stroke low pressure cylinder is preferably effected by means of scavenging ports formed in the cylinder sleeve so that they would be uncovered by the piston towards the end of the expansion stroke. The exhaust will take place either through an exhaust valve arranged in the cylinder head with a view to induce a longitudinal scavenging or through exhaust ports formed in the cylinder sleeve so that the piston uncovers them towards the end of the second expansion but before it uncovers the scavenging ports with a view to perform a cross-flow scavenging.

In order that the scavenging occurs, the fresh air should advantageously be under a light overpressure. This may be achieved either by any blower whatsoever or by the conventional so-called "casing-pump" principle of the two-cycle engine wherein the air is sucked or drawn into the casing. It is in this case that the sleeve of the two-stroke low pressure cylinder may be fitted with air intake ports for the ingress of air towards the casing. These will be uncovered by the piston only when the latter will be near its bottom dead centre position. During its upward stroke the volume downstream of the piston, i.e. the volume of the casing would decrease and the air therein would be slightly compressed.

The main advantage with respect to the existing engines is an increase in the power output efficiency. With powers of heat exchangers and maximum pressures which seem quite admissible the calculations predict an increase in this output efficiency of about 10% to 20% in the case of an engine operating with gasoline. This engine would inherit an advantage of the conventional four stroke engine which is a substantial specific power, i.e. a substantial power-to-swept volume ratio while being devoid of the great defect of the existing two-stroke engines which is fuel being carried along towards the exhaust manifold during scavenging.

Another advantage of the new staged two-stroke engine provided by the invention with respect to the existing four stroke engines is the possibility of adjusting the power in several fashions. The throttling at the suction used heretofore indeed raises problems since as the scavenging pressure becomes too small it would result in a substantial dilution of the fresh air-fuel mixture thereby making the combustion difficult. The staged two-stroke internal combustion cycle allows for instance to adjust the power by means of a throttling at the pre-compressed air discharge pipings or also at the air or precompressed air-fuel mixture intake pipings. In the latter case the pressure in the heat exchanger would rise at partial load and this could be used to meet a sudden call for power. In both instances the scavenging would not be affected by the adjustment of the power.

The second compression ratio, i.e. the volumetric compression ratio of the high pressure combustive cylinder is relatively small (3 . . . 6). The expansion is distributed over a full revolution of the crankshaft. These two factors would substantially decrease the unfavorable influence of a non-instantaneous combustion time. The compactness of the combustion chamber which in fact is the dead space of the high pressure combustive cylinder the swept volume or piston displacement of which is relatively small and the compression ratio of which is small would at first limit in spite of the substantial maximum pressures the mechanical stresses and then avoid an excessive heat loss. It would contribute to avoid pinging in gasoline combustion and probably to increase to richness of the spontaneous combustion. This latter advantage is also due to the small second compression ratio which would avoid too quick a drop of the pressure and of the temperature after the piston has moved beyond the top dead centre.

Another advantage of the new engine is that the exhaust gases are clearly less hot thereby providing a longer lifetime to the exhaust system.

Still another additional advantage resides in the fact that the low pressure cylinder does not undergo combustions hence no sudden pressure and temperature rises thereby allowing the use of materials other than those of the cylinders presently used, which could be advantageous in particular with respect to lubrication and even put up with "dry" friction.

What is claimed is:

1. An internal combustion engine comprising at least three cylinders including a working chamber with a volume variable through the displacement within the cylinder of a piston between a top dead center position and a bottom dead center position under the effect of pressure forces periodically generated within said chamber, to each cylinder being associated gaseous fluid intake means and combustive gas discharge means, the piston of each cylinder being connected to a crankshaft of the engine, wherein at least one cylinder operates as a two-stroke low pressure and two cylinders operate as combustive cylinders and in that the pistons of the low pressure and combustive cylinders, respectively, are connected to the crankshaft so that the pistons of the combustive cylinders on the one hand and the piston of the low pressure cylinder on the other hand are moving in opposite directions, the working chamber of the low pressure cylinder communicating with a gaseous fluid intake way and with a combustive gases exhaust way and with the working chamber of each combustive cylinder on the one hand through a first channel comprising heat exchanger means for discharge in the fluid into this working chamber, through the agency of a discharge valve associated with the low pressure cylinder and of an inlet valve associated with the combustive cylinder and on the other through a second channel way separate from said first channel for transferring the combustible gases through the medium of a transfer valve associated with the combustive cylinder, said valves being operated so that said discharge valve be open during the stroke of the piston of the low pressure cylinder towards its top dead center simultaneously and alternately with the inlet valve of one of the two combustive cylinders and in that the transfer valve of this combustive cylinder is open during the second stroke of the piston of the low pressure cylinder towards its bottom dead center after the intake of the fluid into this cylinder, wherein said internal combustion engine comprises an odd number greater than five of cylinders arranged in line so that at the ends of the crankshaft are located two high pressure combustive cylinders and so that the other combustive cylinders be located between two two-stroke low pressure cylinders and be positioned to communicate with both adjacent two-stroke low pressure cylinders through at least one transfer valve and piping, respectively, so as to transfer during the second expansion the combustible gases contained in the high pressure combustive cylinder into both low pressure cylinders which are associated therewith and in a simultaneous manner.

2. An internal combustion engine of the type comprising a plurality of at least three cylinders each including a working chamber with a volume variable through the displacement within the cylinder of a piston between a top dead center position and a bottom dead center position under the effect of pressure forces periodically generated within said chamber, to each cylinder being associated gaseous fluid intake means and combustive gas discharge means, the piston of each cylinder being connected to a crankshaft of the engine, wherein at least one cylinder operating as a two-stroke low pressure cylinder and two cylinders operating as combustive cylinders and in that the pistons of the low pressure and combustive cylinders, respectively, are connected to the crankshaft so that the pistons of the combustive cylinders on the one hand and the piston of the low pressure cylinder on the other hand are moving in opposite directions, the working chamber of the low pressure cylinder communicating with a gaseous fluid intake way and with a combustible gases exhaust way and with the working chamber of each combustive cylinder on the one hand through a first channel comprising heat exchange means for discharging the fluid into this working chamber, through the agency of a discharge valve associated with the low pressure cylinder and of an inlet valve associated with the combustive cylinder and on the other through a second channel separate from said first channel for transferring the combustible gases through the medium of a transfer valve associated with the combustive cylinder, said valves being operated so that said discharge valve be open during the stroke of the piston of the low pressure cylinder towards its top dead center simultaneously with the inlet valve of one of the two combustive cylinders and in that the transfer valve of this combustive cylinder is open during the second stroke of the piston of the low pressure cylinder towards its bottom dead center after the intake of the fluid into this cylinder.

3. An engine according to claim 2, further comprising three cylinders arranged in line, both high pressure combustive cylinders being located at the ends of the crankshaft to which they are connected.

4. An internal combustion engine comprising five cylinders each including a working chamber with a volume variable through the displacement within the cylinder of a piston between a top dead center position and a bottom dead center position under the effect of pressure forces periodically generated within said chamber, to each cylinder being associated gaseous fluid intake means and combustive gas discharge means, the piston of each cylinder being connected to a crankshaft of the engine, wherein two cylinders operating as two-stroke low pressure cylinders and three cylinders operating as four stroke high pressure combustive cylinders and in that the pistons of the low pressure and of the combustive cylinders, respectively, are connected to the crankshaft so that the pistons of the combustive cylinders on the one hand and the piston of the low pressure cylinder on the other hand are moving in opposite directions, said cylinders being arranged in line, two four stroke combustion cylinders being located at the ends of said crankshaft to which they are connected, the third high pressure combustive cylinder being located in the middle between said two low pressure two stroke cylinders, the working chamber of each low pressure cylinder communicating with a gaseous fluid intake way and with a combustible gases exhaust way and with the working chamber of each of the two adjacent combustive cylinders on the one hand through a first way comprising heat exchanger means for discharging in the precompressed gaseous fluid into this working chamber, through the agency of a discharge valve associated with the low pressure cylinder and of an inlet valve associated with the combustive cylinder and on the other hand through a second way separate from said first way for transferring the combustible gases from the combustive cylinder into the low pressure cylinder through the medium of a transfer valve associated with the combustive cylinder, the third high pressure combustive cylinder located in the middle communicating with each of said both adjacent two-stroke low pressure cylinders through one transfer valve and piping and comprising a single intake valve for simultaneous communications with each of said two low pressure cylinders through a separate communication way provided with heat exchanger means, said valves being operated so that said discharge valve of a low pressure cylinder be open during the stroke of its piston towards its top dead center simultaneously with the inlet valve of one of the adjacent combustive cylinders and in that the transfer valve of this combustive cylinder is open during the second stroke of the piston of the low pressure cylinder towards its bottom dead center after the intake of the fluid into this cylinder.

5. An engine according to claim 4, comprising said heat exchanger the inlets of which are susceptible of communicating with the working chambers of the two-stroke low pressure cylinders through said discharge valves, the heat exchanger being susceptible of communicating through its outlets with the working chambers of the high pressure combustive cylinders through the medium of said inlet valves.

6. An engine according to claim 4, wherein the passage ways for switching the working chambers of the high pressure combustive cylinders comprise means for feeding fuel into the pre-compressed fluid, such as controlled injection means or carburettor means, the working chambers of the high pressure combustive cylinders being fitted with a means for igniting the air-fuel mixture.

7. An engine according to claim 4, wherein the working chambers of the high pressure combustive cylinders comprise means for directly injecting fuel into the compressed air towards the end of the compression in the cylinders so that the fuel ignites spontaneously.

* * * * *